US012000411B2

(12) United States Patent
Fischer

(10) Patent No.: US 12,000,411 B2
(45) Date of Patent: Jun. 4, 2024

(54) FLUID PUMP IMPELLER INCLUDING BLADES EXTENDING FROM A HUB TO AN OUTER RING AND HAVING A DRAFT ANGLE BETWEEN ADJACENT BLADES THAT VARIES BETWEEN THE HUB AND THE OUTER RING

(71) Applicant: DELPHI TECHNOLOGIES IP LIMITED, St. Michael (BB)

(72) Inventor: John G. Fischer, Goodrich, MI (US)

(73) Assignee: PHINIA Delphi Luxembourg SARL, Belvaux (LU)

( * ) Notice: Subject to any disclaimer, the term of this patent is extended or adjusted under 35 U.S.C. 154(b) by 113 days.

(21) Appl. No.: 17/570,650

(22) Filed: Jan. 7, 2022

(65) Prior Publication Data

US 2023/0220849 A1 Jul. 13, 2023

(51) Int. Cl.

| | |
|---|---|
| ***F04D 25/06*** | (2006.01) |
| ***F04D 5/00*** | (2006.01) |
| ***F04D 29/18*** | (2006.01) |
| ***F04D 29/40*** | (2006.01) |
| *F04D 13/08* | (2006.01) |

(52) U.S. Cl.

CPC ..... *F04D 5/002* (2013.01); *F04D 25/06* (2013.01); *F04D 29/18* (2013.01); *F04D 29/188* (2013.01); *F04D 29/406* (2013.01); *F04D 5/001* (2013.01); *F04D 13/08* (2013.01)

(58) Field of Classification Search

None

See application file for complete search history.

(56) References Cited

U.S. PATENT DOCUMENTS

| | | | | |
|---|---|---|---|---|
| 5,807,068 | A | 9/1998 | Dobler et al. | |
| 6,464,450 | B1 | 10/2002 | Fischer | |
| 6,517,310 | B2 * | 2/2003 | Marx | F04D 5/005 415/915 |

(Continued)

FOREIGN PATENT DOCUMENTS

| | | |
|---|---|---|
| CN | 201013655 | 1/2008 |
| EP | 0383238 A2 | 8/1990 |
| EP | 1286041 A2 | 2/2003 |

OTHER PUBLICATIONS

European Search Report from the European Patent Office in Application No. EP23150523, dated May 26, 2023 (1 page).

*Primary Examiner* — Nathan C Zollinger
*Assistant Examiner* — Timothy P Solak
(74) *Attorney, Agent, or Firm* — Warner Norcross + Judd LLP

(57) ABSTRACT

An impeller for a fluid pump includes a hub having an outer surface; an outer ring which is concentric with the hub and having an inner surface; and a plurality of blades extending from a root at the outer surface to a tip at the inner surface. Each of the blades has a first leg and a second leg which meet at a vertex such that a concave side of the blades faces toward a rotational direction and such that a convex side of the blades faces away from the rotational direction. The concave side of each one of the plurality of blades forms a draft angle with the convex side of another one of the plurality of blades which is immediately adjacent thereto in the rotational direction. The draft angle at the inner surface is less than or equal to 10% of the draft angle at the outer surface.

20 Claims, 3 Drawing Sheets

(56) References Cited

U.S. PATENT DOCUMENTS

| | | | | |
|---|---|---|---|---|
| 6,527,506 | B2 | 3/2003 | Pickelman et al. | |
| 6,533,538 | B2 | 3/2003 | Aslam et al. | |
| RE39,891 | E * | 10/2007 | Pickelman | F04D 29/188 415/55.1 |
| 7,500,820 | B2 * | 3/2009 | Inuzuka | F04D 29/188 415/55.1 |
| 7,597,543 | B2 * | 10/2009 | Narisako | F04D 29/188 415/55.1 |
| 9,546,666 | B2 * | 1/2017 | Lee | F04D 29/188 |
| 2001/0036400 | A1 | 11/2001 | Kobayashi et al. | |
| 2003/0231952 | A1 | 12/2003 | Moss | |
| 2005/0226716 | A1 * | 10/2005 | Baek | F04D 29/188 415/58.4 |
| 2006/0228207 | A1 | 10/2006 | Baek et al. | |

* cited by examiner

FLUID PUMP IMPELLER INCLUDING BLADES EXTENDING FROM A HUB TO AN OUTER RING AND HAVING A DRAFT ANGLE BETWEEN ADJACENT BLADES THAT VARIES BETWEEN THE HUB AND THE OUTER RING

TECHNICAL FIELD OF INVENTION

The present disclosure relates to a fluid pump with an impeller having a plurality of blades; particularly to a such a fluid pump where a draft angle between adjacent pairs of the plurality of blades varies along the radial length of the plurality of blades.

BACKGROUND OF INVENTION

Fluid pumps for pumping fluids, for example liquid fuel, are known in the art. One example of such a fluid pump is shown in U.S. Pat. No. 6,527,506 to Pickelman et al. In such arrangements, an impeller is rotated, for example by an electric motor. The impeller is sandwiched between two plates which each have a respective flow channel formed in a face thereof such that each flow channel faces toward the impeller. The impeller includes a plurality of blades arranged in a polar array such that the blades are aligned with the flow channels of the two plates. Each blade may be a V-shape such that the concave side of the V-shape faces toward the direction of rotation of the impeller and the convex side of the V-shape faces away from the direction of rotation of the impeller. The impeller, including the plurality of blades, may be made as a unitary piece of plastic in an injection molding process where a pair of opposing molds form upper and lower halves of each blade. In order to allow for extraction of the impeller from the molds, a draft angle, typically about 10°, is provided between each adjacent pair of blades. Furthermore, this draft angle is maintained along the radial length of each blade. This draft angle minimizes friction as the molds are extracted, thereby minimizing the likely hood of damage to the blades. However, this arrangement also causes the distance between adjacent blades to widen further from the center of the impeller, much like spokes on a bicycle wheel. In operation, fuel enters between adjacent blades on the inboard half of the blade radial length and centrifugal forces causes the fuel to exit the blade on the outboard half of the of the blade radial length. Since the distance between adjacent blades widens from inboard to outboard, the flow stream exiting the blade diverges which may be undesirable for momentum transfer of the fuel, thereby leading to decreased pumping efficiency.

What is needed is a fluid pump and impeller which minimizes or eliminates one or more of the shortcomings as set forth above.

SUMMARY OF THE INVENTION

Briefly described, the present disclosure provides an impeller for a fluid pump. The impeller includes a hub configured to be rotationally coupled to a shaft of the fluid pump such that the shaft provides rotational motion in a rotational direction about an axis, the hub having an outer surface; an outer ring which is concentric with the hub, the outer ring having an inner surface; and a plurality of blades extending from a root at the outer surface of the hub to a tip at the inner surface of the outer ring, each one of the plurality of blades having a first leg and a second leg which meet at a vertex, thereby forming a V-shape such that a concave side of the V-shape faces toward the rotational direction and such that a convex side of the V-shape faces away from the rotational direction. The first leg, at the concave side of each one of the plurality of blades, forms a draft angle with the first leg at the convex side of another one of the plurality of blades which is immediately adjacent thereto in the rotational direction. The draft angle at the inner surface of the outer ring is less than or equal to 10% of the draft angle at the outer surface of the hub.

The present disclosure also provides a fluid pump which includes a housing; an electric motor within the housing, the electric motor having a shaft which rotates when electricity is applied to the electric motor; and an impeller located between an inlet plate having an inlet plate flow channel facing toward the impeller and an outlet plate having an outlet plate flow channel facing toward the impeller. The impeller includes a hub rotationally coupled to the shaft such that the shaft provides rotational motion in a rotational direction about an axis, the hub having an outer surface; an outer ring which is concentric with the hub, the outer ring having an inner surface; and a plurality of blades extending from a root at the outer surface of the hub to a tip at the inner surface of the outer ring, each one of the plurality of blades having a first leg and a second leg which meet at a vertex, thereby forming a V-shape such that a concave side of the V-shape faces toward the rotational direction and such that a convex side of the V-shape faces away from the rotational direction. The first leg, at the concave side of each one of the plurality of blades, forms a draft angle with the first leg at the convex side of another one of the plurality of blades which is immediately adjacent thereto in the rotational direction. The draft angle at the inner surface of the outer ring is less than or equal to 10% of the draft angle at the outer surface of the hub.

The fluid pump and impeller as described herein provides for increased pumping efficiency while maintaining manufacturability of the impeller.

BRIEF DESCRIPTION OF DRAWINGS

This invention will be further described with reference to the accompanying drawings in which.

DETAILED DESCRIPTION OF INVENTION

Figure 1:
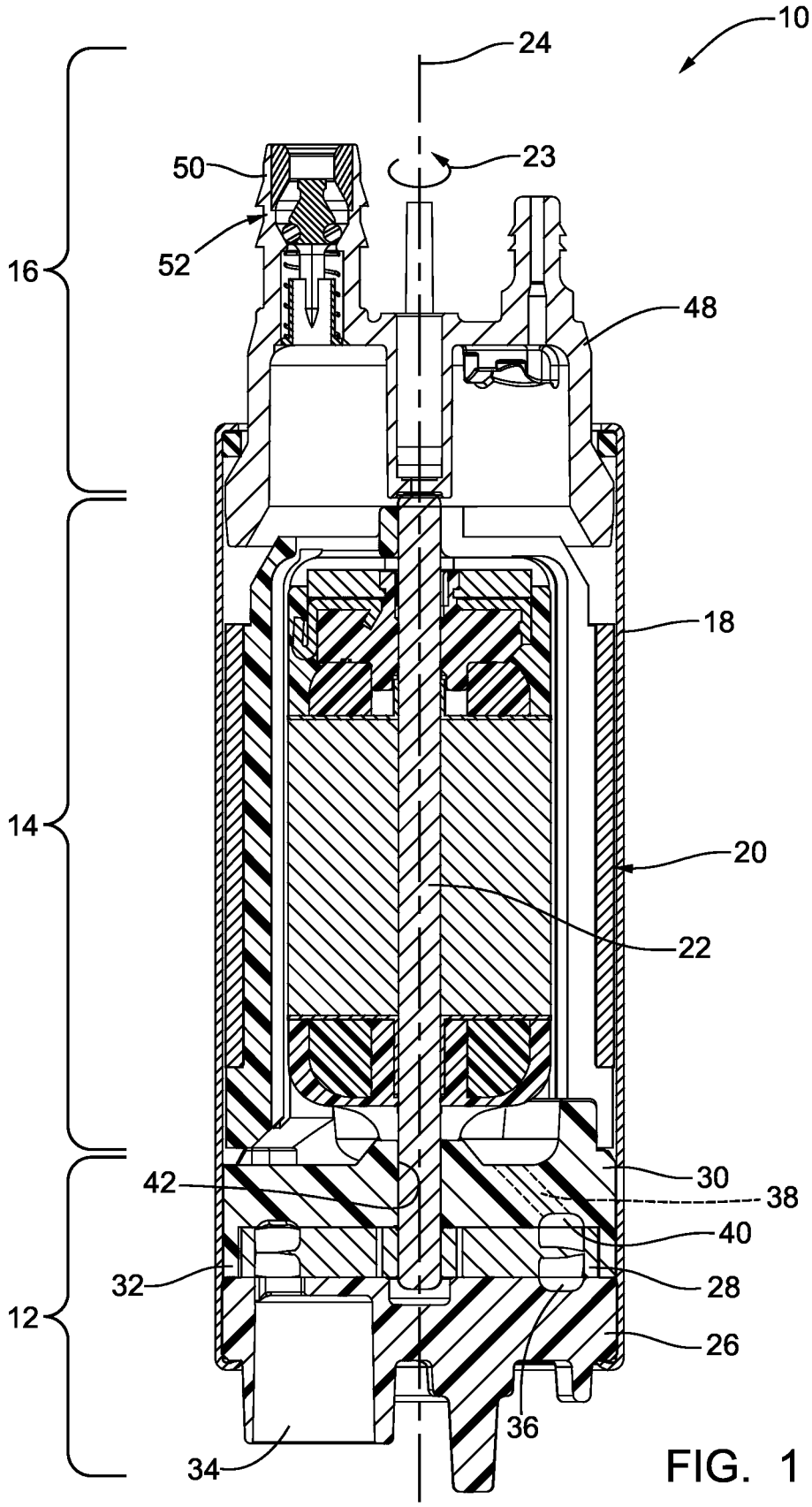
FIG. 1 is an axial cross-sectional view of a fluid pump in accordance with the present disclosure.

Referring initially to FIG. 1, a fluid pump is illustrated, by way of non-limiting example only, as a fuel pump 10. Fuel pump 10 may be, by way of non-limiting example only, submersed in a fuel tank (not shown) which pumps fuel to a fuel consuming device (also not shown) such as an internal combustion engine. The fuel pumped by fuel pump 10 may be any liquid fuel customarily used, for example only, gasoline, diesel fuel, alcohol, ethanol, and the like, and blends thereof.

Fuel pump 10 generally includes a pump section 12 at one end, a motor section 14 adjacent to pump section 12, and an outlet section 16 adjacent to motor section 14 at the end of fuel pump 10 opposite pump section 12. A housing 18 of fuel pump 10 is tubular and retains pump section 12, motor section 14 and outlet section 16 together. Fuel enters fuel pump 10 at pump section 12, a portion of which is rotated by motor section 14 as will be described in more detail later, and is pumped past motor section 14 to outlet section 16 where the fuel exits fuel pump 10.

Motor section 14 includes an electric motor 20 which is disposed within housing 18. Electric motor 20 includes a shaft 22 extending therefrom into pump section 12. Shaft 22 rotates in a rotational direction 23 about an axis 24 when an electric current is applied to electric motor 20. Electric motors and their operation are well known to those of ordinary skill in the art and will not be described in greater detail herein.

Pump section 12 includes an inlet plate 26, a pumping element illustrated as impeller 28, and an outlet plate 30. Inlet plate 26 is disposed at the end of pump section 12 that is distal from motor section 14 while outlet plate 30 is disposed at the end of pump section 12 that is proximal to motor section 14. Both inlet plate 26 and outlet plate 30 are fixed relative to housing 18 to prevent relative movement between inlet plate 26 and outlet plate 30 with respect to housing 18. Outlet plate 30 defines a spacer ring 32 on the side of outlet plate 30 that faces toward inlet plate 26. Impeller 28 is disposed axially between inlet plate 26 and outlet plate 30 such that impeller 28 is radially surrounded by spacer ring 32. Impeller 28 is fixed to shaft 22 such that impeller 28 rotates with shaft 22 in a one-to-one relationship. Spacer ring 32 is dimensioned to be slightly thicker than the dimension of impeller 28 in the direction of axis 24, i.e. the dimension of spacer ring 32 in the direction of axis 24 is greater than the dimension of impeller 28 in the direction of axis 24. In this way, inlet plate 26, outlet plate 30, and spacer ring 32 are fixed within housing 18, for example by crimping the axial ends of housing 18. Axial forces created by the crimping process will be carried by spacer ring 32, thereby preventing impeller 28 from being clamped tightly between inlet plate 26 and outlet plate 30 which would prevent impeller 28 from rotating freely. Spacer ring 32 is also dimensioned to have an inside diameter that is larger than the outside diameter of impeller 28 to allow impeller 28 to rotate freely within spacer ring 32 and axially between inlet plate 26 and outlet plate 30. While spacer ring 32 is illustrated as being made as a single piece with outlet plate 30, it should be understood that spacer ring 32 may alternatively be made as a separate piece that is captured axially between outlet plate 30 and inlet plate 26.

Inlet plate 26 is generally cylindrical in shape, and includes an inlet passage 34 that extends through inlet plate 26 in the same direction as axis 24. Inlet passage 34 is a passage which introduces fuel into fuel pump 10 housing 18. Inlet plate 26 also includes an inlet plate flow channel 36 formed in the face of inlet plate 26 that faces toward impeller 28. Inlet plate flow channel 36 is a segment of an annulus and is in fluid communication with inlet passage 34.

Outlet plate 30 is generally cylindrical in shape and includes an outlet plate outlet passage 38 that extends through outlet plate 30 where it should be noted that outlet plate outlet passage 38 is an outlet for pump section 12. Outlet plate outlet passage 38 is in fluid communication with outlet section 16. Outlet plate 30 also includes an outlet plate flow channel 40 formed in the face of outlet plate 30 that faces toward impeller 28. Outlet plate flow channel 40 is a segment of an annulus and is in fluid communication with outlet plate outlet passage 38. Outlet plate 30 also includes an outlet plate aperture, hereinafter referred to as lower bearing 42, extending through outlet plate 30. Shaft 22 extends through lower bearing 42 in a close-fitting relationship such that shaft 22 is able to rotate freely within lower bearing 42 and such that radial movement of shaft 22 within lower bearing 42 is limited to the manufacturing tolerances of shaft 22 and lower bearing 42. In this way, lower bearing 42 radially supports a lower end of shaft 22 that is proximal to pump section 12.

Figure 2:
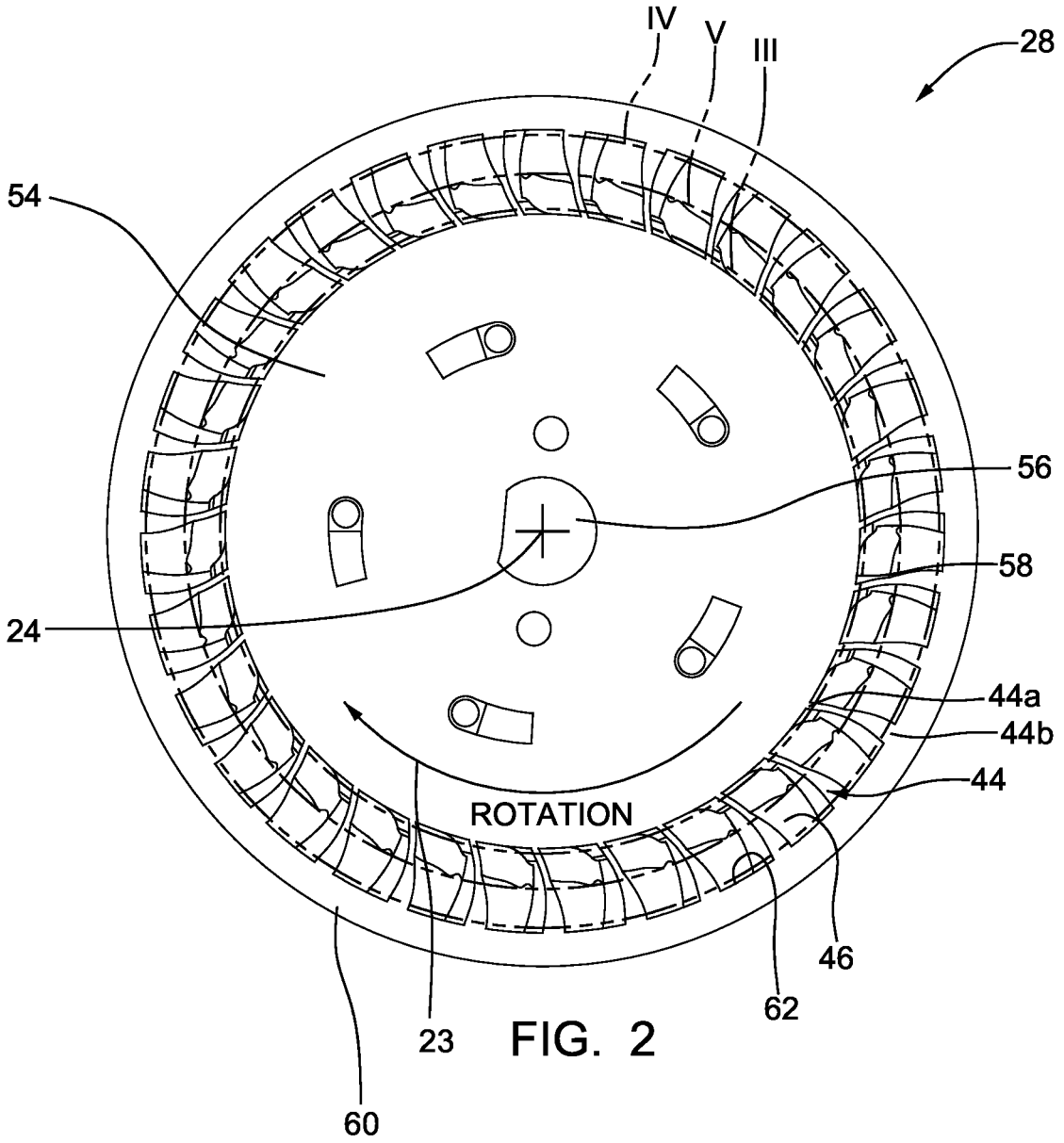
FIG. 2 is an axial end view of an impeller of the fluid pump of FIG. 1 as viewed in a direction looking upward in FIG. 1.

With continued reference to FIG. 1 and now with additional reference to FIG. 2, impeller 28 includes a plurality of blades 44, as can be most clearly seen in FIG. 2, arranged in a polar array radially surrounding, and centered about axis 24, such that blades 44 are aligned with inlet plate flow channel 36 and outlet plate flow channel 40. Blades 44 are each separated from each other by a respective blade chamber 46 that passes through impeller 28 in the general direction of axis 24. Impeller 28 may be made, for example only, by a plastic injection molding process in which the preceding features of impeller 28 are integrally molded as a single piece of plastic. Impeller 28 and blades 44 will be described in greater detail later.

Outlet section 16 includes an end cap 48 which closes the upper end of housing 18. End cap 48 includes an outlet conduit 50 which provides fluid communication out of housing 18 such that outlet conduit 50 is in fluid communication with outlet plate outlet passage 38 of outlet plate 30 for receiving fuel that has been pumped by pump section 12. Rotation of impeller 28 by shaft 22 causes fluid to be pumped from inlet passage 34 to outlet conduit 50 and to be pressurized within housing 18 such that pressurized fuel is communicated out of housing 18. In order to prevent a backflow of fuel into housing 18 through outlet conduit 50, fuel pump 10 may also include a check valve assembly 52 which allows fuel to flow out of fuel pump 10 through outlet conduit 50 but prevents fuel from flowing into fuel pump 10 through outlet conduit 50.

Impeller 28 will now be described in greater detail with particular reference to FIGS. 2-5B. Impeller 28 includes a hub 54 defining an aperture 56 extending axially therethrough at a center of hub 54. As embodied herein, shaft 22 extends into aperture 56 and shaft 22 is rotationally coupled to hub 54 by way of complementary features which cause rotational motion of shaft 22 to be transferred to impeller 28 in rotational direction 23 about axis 24. However, it should be understood that any known method of rotational coupling may be provided in the alternative. Hub 54 includes an outer surface 58 which surrounds, and extends along, axis 24 and which may be cylindrical. Impeller 28 also includes an outer ring 60 which is concentric to hub 54. Outer ring 60 includes an inner surface 62 which surrounds, and extends along, axis 24 and which may be cylindrical.

Each blade 44 extends radially outward from a respective root 44*a* at outer surface 58 to a tip 44*b* at inner surface 62. Each blade 44 includes a first leg 44*c* and a second leg 44*d*, which meet at a vertex 44*e*, thereby forming a V-shape such that a concave side 44*f* of the V-shape faces toward rotational direction 23 and such that a convex side 44*g* of the V-shape faces away from rotational direction 23.

Figure 3A:
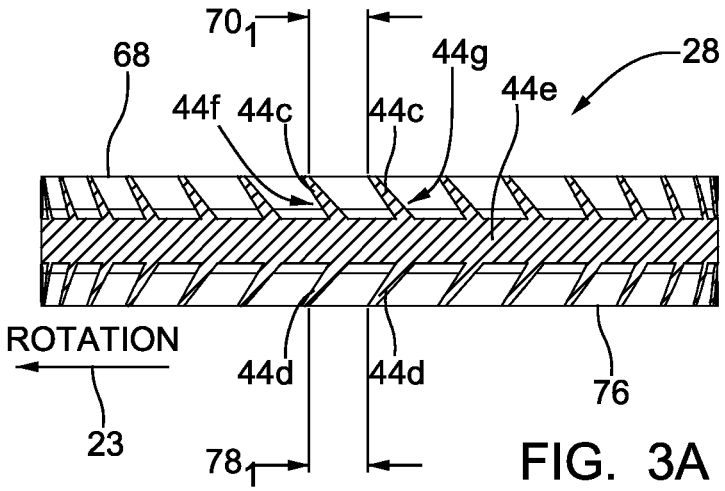
FIG. 3A is a cross sectional view of the impeller, taken through circular section line III of FIG. 2.
Figure 3B:
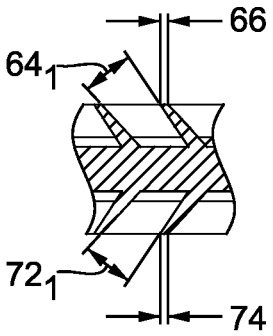
FIG. 3B is a portion of FIG. 3A.
Figure 4A:
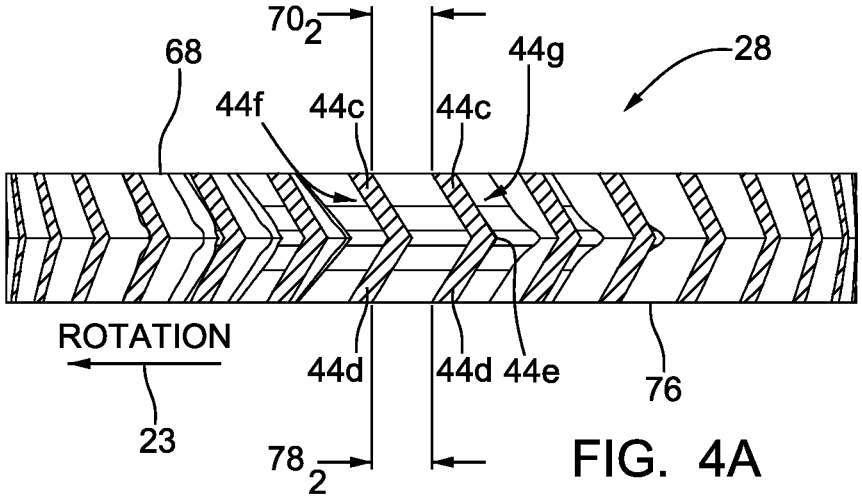
FIG. 4A is a cross sectional view of the impeller, taken through circular section line IV of FIG. 2.
Figure 4B:
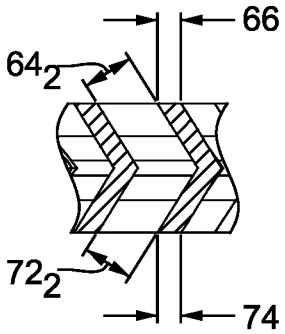
FIG. 4B is a portion of FIG. 4A.
Figure 5A:
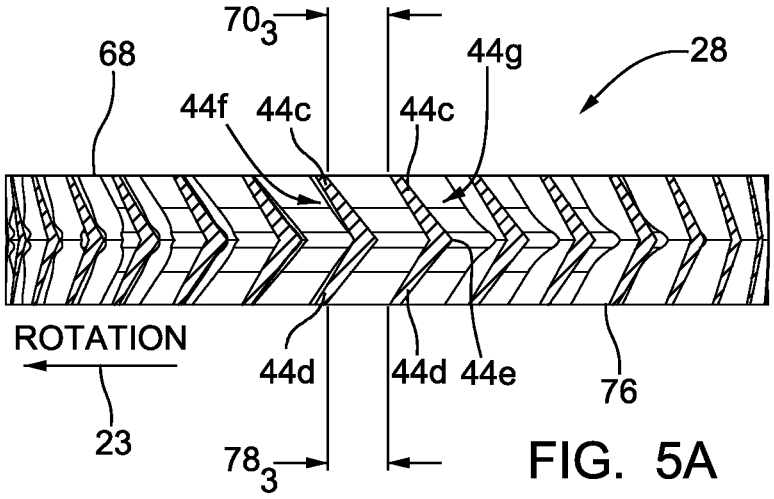
FIG. 5A is a cross sectional view of the impeller, taken through circular section line V of FIG. 2.
Figure 5B:
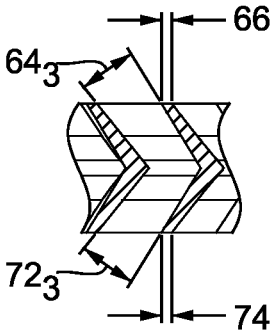
FIG. 5B is a portion of FIG. 5A.

For each blade 44, concave side 44*f* of first leg 44*c* forms a draft angle $\mathbf{64}_n$ with convex side 44*g* of first leg 44*c* of the blade 44 which is immediately adjacent thereto in rotational direction 23 where n is used to represent different radial locations between outer surface 58 and inner surface 62 because draft angle $\mathbf{64}_n$ varies between outer surface 58 and inner surface 62 and therefore is not uniform. As illustrated in FIG. 3B, draft angle $\mathbf{64}_n$ at outer surface 58 of hub 54, i.e. root 44*a*, is represented as draft angle $\mathbf{64}_1$ and is in a range of 5° to 10° with preference of being closer to 10° in order to facilitate extraction of a mold (not shown) used in a plastic injection molding manufacturing process since a larger draft angle is desirable for manufacturing because it quickly separates the surfaces of blades 44 from the mold, thereby minimizing friction and the likelihood of causing damage to blades 44. Now, as illustrated in FIG. 4B, draft angle $\mathbf{64}_n$ at inner surface 62 of outer ring 60, i.e. tip 44*b*, is represented as draft angle $\mathbf{64}_2$ and is less than or equal to 10% of draft angle $\mathbf{64}_1$ such that draft angle $\mathbf{64}_2$ is preferably less than 1° in order to promote high momentum transfer of the fuel during operation. Now, as illustrated in FIG. 5B, draft angle $\mathbf{64}_n$ at a midpoint, i.e. equidistant, between outer surface 58 of hub 54 and inner surface 62 of outer ring 60 is represented as draft angle $\mathbf{64}_3$ and is greater than or equal to 90% of draft angle $\mathbf{64}_1$. As a result, draft angle $\mathbf{64}_n$ changes very little from inner surface 62 of outer ring 60 and the midpoint between outer surface 58 of hub 54 and inner surface 62 of outer ring 60 which facilitates extraction of the mold. Also as a result, draft angle $\mathbf{64}_n$ decreases primarily from the midpoint and inner surface 62 of outer ring 60. While draft angle $\mathbf{64}_n$ between the midpoint and inner surface 62 of outer ring 60 decreases to values which are typically not desirable for manufacturability, these lower draft angles occur for less than half of the radial distance from outer surface 58 of hub 54 and inner surface 62 of outer ring 60 and therefore increases friction over a small area which still permits satisfactory extraction of the mold during manufacturing.

Each blade 44 has a thickness 66 which is measured in a direction perpendicular to the radial direction relative to axis 24, i.e. perpendicular to a radius extending perpendicular from axis 24 through the center of blade 44 at the point at which thickness 66 is being measured. Furthermore, thickness 66 is measured at a blade axial face 68 of each blade 44 which is proximal to outlet plate 30. Thickness 66 is substantially uniform from outer surface 58 of hub 54 to the midpoint between outer surface 58 of hub 54 and inner surface 62 of outer ring 60, however, thickness 66 increases between the midpoint and inner surface 62 of outer ring 60 where substantially uniform is not varying by more than ±10%. This relationship of thickness 66 provides for a blade chamber distance $\mathbf{70}_n$ which varies between outer surface 58 of hub 54 and inner surface 62 of outer ring 60 where n is used to represent different radial locations between outer surface 58 and inner surface 62. Blade chamber distance $\mathbf{70}_n$ is the measure from concave side 44*f* of one blade 44 to convex side 44*g* of another blade 44 which is immediately adjacent thereto in rotational direction 23 and is measured in a direction perpendicular to the radial direction relative to axis 24 (i.e. perpendicular to a radius extending perpendicular from axis 24 through the center of blade chamber 46 at the point at which blade chamber distance $\mathbf{70}_n$ is being measured). Furthermore, blade chamber distance $\mathbf{70}_n$ is measured at blade axial face 68. As illustrated in FIG. 3A, blade chamber distance $\mathbf{70}_n$ at outer surface 58 of hub 54, i.e. root 44*a*, is represented as blade chamber distance $\mathbf{70}_n$. Since thickness 66 is substantially uniform from outer surface 58 of hub 54 to the midpoint between outer surface 58 of hub 54 and inner surface 62 of outer ring 60, blade chamber distance $\mathbf{70}_n$ increases from outer surface 58 of hub 54 to the midpoint between outer surface 58 of hub 54 and inner surface 62 of outer ring 60. Blade chamber distance $\mathbf{70}_n$ at the midpoint is represented as blade chamber distance $\mathbf{70}_3$ as illustrated in FIG. 5A. However, blade chamber distance $\mathbf{70}_n$ decreases from the midpoint to outer surface 58 of hub 54 such that a blade chamber distance $\mathbf{70}_2$, illustrated in FIG. 4A, at inner surface 62 of outer ring 60, i.e. tip 44*b*, is substantially equal to blade chamber distance $\mathbf{70}_1$ at outer surface 58 of hub 54 where substantially equal to is ±10% of blade chamber distance $\mathbf{70}_1$.

Fuel is drawn into each blade chamber 46 at a location between outer surface 58 of hub 54 and the midpoint of outer surface 58 of hub 54 and inner surface 62 of outer ring 60 and centrifugal force causes the fuel to be expelled from each blade chamber 46 at a location between the midpoint and inner surface 62 of outer ring 60 where the fuel continually recirculates in this way as the fuel travels through, and is pressurized within, outlet plate flow channel 40 before exiting through outlet plate outlet passage 38. Due to the previously mentioned characteristics of draft angle $\mathbf{64}_n$ from the midpoint to the inner surface 62 of outer ring 60 and of blade chamber distance $\mathbf{70}_n$ from the midpoint to the inner surface 62 of outer ring 60, momentum transfer of fuel exiting blade chamber 46 and entering outlet plate flow channel 40 is promoted which increases pumping efficiency. It should be recognized that the draft angles at the entrance region of the blade length and the outlet region of the blade length can be independently adjusted to tune the flow path for efficient flow of the fluid entering the blade and efficient momentum transfer of fluid exiting the blade, i.e. adjust to the optimum spot for the operating point of the fuel pump. Computational Fluid Dynamics (CFD) analysis has indicated that this arrangement yields 51.2% efficiency in comparison to 48.4% efficiency for a fuel pump which did not include impeller 28 as describe herein but was otherwise equivalent in design. This results in increasing efficiency by 5.8%.

The characteristics of first legs 44*c* as described above are also provided to second legs 44*d*, however, for the sake of completeness, these characteristics will now be described with respect to second legs 44*d*. For each blade 44, concave side 44*f* of second leg 44*d* forms a draft angle $\mathbf{72}_n$ with convex side 44*g* of second leg 44*d* of the blade 44 which is immediately adjacent thereto in rotational direction 23 where n is used to represent different radial locations between outer surface 58 and inner surface 62 because draft angle $\mathbf{72}_n$ varies between outer surface 58 and inner surface 62 and therefore is not uniform. As illustrated in FIG. 3B, draft angle $\mathbf{72}_n$ at outer surface 58 of hub 54, i.e. root 44*a*, is represented as draft angle $\mathbf{72}_1$ and is in the range of 5° to 10° with preference of being closer to 10° in order to facilitate extraction of a mold (not shown) used in a plastic injection molding manufacturing process since a larger draft angle quickly separates the surfaces of blades 44 from the mold, thereby minimizing friction and the likelihood of causing damage to blades 44. Now, as illustrated in FIG. 4B, draft angle $\mathbf{72}_n$ at inner surface 62 of outer ring 60, i.e. tip 44*b*, is represented as draft angle $\mathbf{72}_2$ and is less than or equal to 10% of draft angle $\mathbf{72}_1$ such that draft angle $\mathbf{72}_2$ is preferably less than 1° in order to promote high momentum transfer of the fuel. Now, as illustrated in FIG. 5B, draft angle $\mathbf{72}_n$ at a midpoint, i.e. equidistant, between outer surface 58 of hub 54 and inner surface 62 of outer ring 60 is represented as draft angle $\mathbf{72}_3$ and is greater than or equal to 90% of draft angle $\mathbf{72}_1$. As a result, draft angle $\mathbf{72}_n$ changes very little from inner surface 62 of outer ring 60 and the midpoint between outer surface 58 of hub 54 and inner surface 62 of outer ring 60 which facilitates extraction of the mold. Also as a result, draft angle $72_n$ decreases primarily from the midpoint and inner surface 62 of outer ring 60. While draft angle $72_n$ between the midpoint and inner surface 62 of outer ring 60 decreases to values which are typically not desirable for manufacturability, these lower draft angles occur for less than half of the radial distance from outer surface 58 of hub 54 and inner surface 62 of outer ring 60 and therefore increases friction over a small area which still permits satisfactory extraction of the mold during manufacturing.

Each blade 44 has a thickness 74 which is measured in a direction perpendicular to the radial direction relative to axis 24, i.e. perpendicular to a radius extending perpendicular from axis 24 through the center of blade 44 at the point at which thickness 74 is being measured. Furthermore, thickness 74 is measured at a blade axial face 76 of each blade 44 which is proximal to inlet plate 26. Thickness 74 is substantially uniform from outer surface 58 of hub 54 to the midpoint between outer surface 58 of hub 54 and inner surface 62 of outer ring 60, however, thickness 74 increases between the midpoint and inner surface 62 of outer ring 60 where substantially uniform is not varying by more than ±10%. This relationship of thickness 74 provides for a blade chamber distance $78_n$ which varies between outer surface 58 of hub 54 and inner surface 62 of outer ring 60 where n is used to represent different radial locations between outer surface 58 and inner surface 62. Blade chamber distance $78_n$ is the measure from concave side 44*f* of one blade 44 to convex side 44*g* of another blade 44 which is immediately adjacent thereto in rotational direction 23 and is measured in a direction perpendicular to the radial direction relative to axis 24 (i.e. perpendicular to a radius extending perpendicular from axis 24 through the center of blade chamber 46 at the point at which blade chamber distance $78_n$ is being measured). Furthermore, blade chamber distance $78_n$ is measured at blade axial face 76. As illustrated in FIG. 3A, blade chamber distance $78_n$ at outer surface 58 of hub 54 is represented as blade chamber distance $78_1$. Since thickness 74 is substantially uniform from outer surface 58 of hub 54 to the midpoint between outer surface 58 of hub 54 and inner surface 62 of outer ring 60, blade chamber distance $78_n$ increases from outer surface 58 of hub 54 to the midpoint between outer surface 58 of hub 54 and inner surface 62 of outer ring 60. Blade chamber distance $78_n$ at the midpoint is represented as blade chamber distance $78_3$ as illustrated in FIG. 5A. However, blade chamber distance $78_n$ decreases from the midpoint to inner surface 62 of outer ring 60 such that a blade chamber distance $78_2$, illustrated in FIG. 4A, at inner surface 62 of outer ring 60 is substantially equal to blade chamber distance $78_1$ at outer surface 58 of hub 54 where substantially equal to is ±10% of blade chamber distance $78_1$.

It should be noted that all blades 44 of impeller 28 are substantially identical and at least one of the described features has been labeled in the figures for representative purposes and convenience. Consequently, it should be understood that reference characters used to denote a feature in the figures for one blade have the same meaning for each blade 44 although not specifically labeled in the figures.

Fuel is drawn into each blade chamber 46 at a location between outer surface 58 of hub 54 and the midpoint of outer surface 58 of hub 54 and inner surface 62 of outer ring 60 and centrifugal force causes the fuel to be expelled from each blade chamber 46 at a location between the midpoint and inner surface 62 of outer ring 60 where the fuel continually recirculates in this way as the fuel travels through, and is pressurized within, outlet plate flow channel 40 before exiting through outlet plate outlet passage 38. Due to the previously mentioned characteristics of draft angle $72_n$ from the midpoint to the inner surface 62 of outer ring 60 and of blade chamber distance $78_n$ from the midpoint to the inner surface 62 of outer ring 60, momentum transfer of fuel exiting blade chamber 46 and entering outlet plate flow channel 40 is promoted which increases pumping efficiency. It should be recognized that the draft angles at the entrance region of the blade length and the outlet region of the blade length can be independently adjusted to tune the flow path for efficient flow of the fluid entering the blade and efficient momentum transfer of fluid exiting the blade, i.e. adjust to the optimum spot for the operating point of the fuel pump. Computational Fluid Dynamics (CFD) analysis has indicated that this arrangement yields 51.2% efficiency in comparison to 48.4% efficiency for a fuel pump which did not include impeller 28 as describe herein but was otherwise equivalent in design. This results in increasing efficiency by 5.8%.

Fuel pump 10 which in includes impeller 28 as described herein provides for increased pumping efficiency while maintaining manufacturability of impeller 28.

While this invention has been described in terms of preferred embodiments thereof, it is not intended to be so limited, but rather only to the extent set forth in the claims that follow.

I claim:

1. An impeller for a fluid pump, said impeller comprising:

a hub configured to be rotationally coupled to a shaft of said fluid pump such that said shaft provides rotational motion in a rotational direction about an axis, said hub having an outer surface;

an outer ring which is concentric with said hub, said outer ring having an inner surface; and a plurality of blades extending from a root at said outer surface of said hub to a tip at said inner surface of said outer ring, each one of said plurality of blades having a first leg and a second leg which meet at a vertex, thereby forming a V-shape such that a concave side of said V-shape faces toward said rotational direction and such that a convex side of said V-shape faces away from said rotational direction;

wherein said first leg, at said concave side of each one of said plurality of blades, forms a draft angle with said first leg at said convex side of another one of said plurality of blades which is immediately adjacent thereto in said rotational direction; and wherein said draft angle at said inner surface of said outer ring is less than or equal to 10% of said draft angle at said outer surface of said hub.

2. An impeller as in claim 1, wherein said draft angle at a midpoint between said outer surface of said hub and said inner surface of said outer ring is greater than or equal to 90% of said draft angle at said outer surface of said hub.

3. An impeller as in claim 2, wherein said draft angle at said outer surface of said hub is in a range of 5° to 10°.

4. An impeller as in claim 1, wherein:

each of said plurality of blades is bounded axially by a first surface and by a second surface; and a first distance from said root of said first leg, at said concave side of each one of said plurality of blades and at said first surface, to said root of said first leg, at said convex side and at said first surface, of said another one of said plurality of blades which is immediately adjacent thereto in said rotational direction is substantially equal to a second distance from said tip of said first leg, at said concave side of each one of said plurality of blades and at said first surface, to said tip of said first leg, at said convex side and at said first surface, of said another one of said plurality of blades which is immediately adjacent thereto in said rotational direction.

5. An impeller as in claim 4, wherein a third distance from a midpoint of said first leg, at said concave side of each one of said plurality of blades and at said first surface, to a midpoint of said first leg, at said convex side and at said first surface, of said another one of said plurality of blades which is immediately adjacent thereto in said rotational direction is greater than said first distance.

6. An impeller as in claim 1, wherein:

each of said plurality of blades is bounded axially by a first surface and by a second surface;

each one of said plurality of blades has a thickness from said concave side to said convex side at said first surface; and said thickness is substantially uniform from said outer surface of said hub to a midpoint between said outer surface of said hub and said inner surface of said outer ring.

7. An impeller as in claim 6, wherein said thickness increases from said midpoint to said inner surface of said outer ring.

8. An impeller as in claim 1, wherein said second leg, at said concave side of each one of said plurality of blades, forms a second draft angle with said second leg at said convex side of another one of said plurality of blades which is immediately adjacent thereto in said rotational direction; and wherein said second draft angle at said inner surface of said outer ring is less than or equal to 10% of said second draft angle at said outer surface of said hub.

9. An impeller as in claim 8, wherein said second draft angle at said outer surface of said hub said is in a range of 5° to 10°.

10. An impeller as in claim 8, wherein:

said draft angle at a midpoint between said outer surface of said hub and said inner surface of said outer ring is greater than or equal to 90% of said draft angle at said outer surface of said hub; and said second draft angle at said midpoint between said outer surface of said hub and said inner surface of said outer ring is greater than or equal to 90% of said second draft angle at said outer surface of said hub.

11. A fluid pump comprising:

a housing;

an electric motor within said housing, said electric motor having a shaft which rotates when electricity is applied to said electric motor;

an impeller located between an inlet plate having an inlet plate flow channel facing toward said impeller and an outlet plate having an outlet plate flow channel facing toward said impeller, wherein said impeller comprises:

a hub rotationally coupled to said shaft such that said shaft provides rotational motion in a rotational direction about an axis, said hub having an outer surface;

an outer ring which is concentric with said hub, said outer ring having an inner surface; and a plurality of blades extending from a root at said outer surface of said hub to a tip at said inner surface of said outer ring, each one of said plurality of blades having a first leg and a second leg which meet at a vertex, thereby forming a V-shape such that a concave side of said V-shape faces toward said rotational direction and such that a convex side of said V-shape faces away from said rotational direction;

wherein said first leg, at said concave side of each one of said plurality of blades, forms a draft angle with said first leg at said convex side of another one of said plurality of blades which is immediately adjacent thereto in said rotational direction; and wherein said draft angle at said inner surface of said outer ring is less than or equal to 10% of said draft angle at said outer surface of said hub.

12. A fluid pump as in claim 11, wherein said draft angle at a midpoint between said outer surface of said hub and said inner surface of said outer ring is greater than or equal to 90% of said draft angle at said outer surface of said hub.

13. A fluid pump as in claim 12, wherein said draft angle at said outer surface of said hub is in a range of 5° to 10°.

14. A fluid pump as in claim 11, wherein:

each of said plurality of blades is bounded axially by a first surface and by a second surface; and a first distance from said root of said first leg, at said concave side of each one of said plurality of blades and at said first surface, to said root of said first leg, at said convex side and at said first surface, of said another one of said plurality of blades which is immediately adjacent thereto in said rotational direction is substantially equal to a second distance from said tip of said first leg, at said concave side of each one of said plurality of blades and at said first surface, to said tip of said first leg, at said convex side and at said first surface, of said another one of said plurality of blades which is immediately adjacent thereto in said rotational direction.

15. A fluid pump as in claim 14, wherein a third distance from a midpoint of said first leg, at said concave side of each one of said plurality of blades and at said first surface, to a midpoint of said first leg, at said convex side and at said first surface, of said another one of said plurality of blades which is immediately adjacent thereto in said rotational direction is greater than said first distance.

16. A fluid pump as in claim 11, wherein:

each of said plurality of blades is bounded axially by a first surface and by a second surface;

each one of said plurality of blades has a thickness from said concave side to said convex side at said first surface; and said thickness is substantially uniform from said outer surface of said hub to a midpoint between said outer surface of said hub and said inner surface of said outer ring.

17. A fluid pump as in claim 16, wherein said thickness increases from said midpoint to said inner surface of said outer ring.

18. A fluid pump as in claim 11, wherein said second leg, at said concave side of each one of said plurality of blades, forms a second draft angle with said second leg at said convex side of another one of said plurality of blades which is immediately adjacent thereto in said rotational direction; and wherein said second draft angle at said inner surface of said outer ring is less than or equal to 10% of said second draft angle at said outer surface of said hub.

19. A fluid pump as in claim 18, wherein:

said draft angle at a midpoint between said outer surface of said hub and said inner surface of said outer ring is greater than or equal to 90% of said draft angle at said outer surface of said hub; and said second draft angle at said midpoint between said outer surface of said hub and said inner surface of said outer ring is greater than or equal to 90% of said second draft angle at said outer surface of said hub.

20. A fluid pump as in claim 19, wherein said second draft angle at said outer surface of said hub said is in a range of 5° to 10°.

* * * * *